US006979942B2

(12) United States Patent
Pruvost et al.

(10) Patent No.: US 6,979,942 B2
(45) Date of Patent: Dec. 27, 2005

(54) CATHODE EMISSIVE BODY FOR AN IMPREGNATED CATHODE OF AN ELECTRON TUBE

(75) Inventors: Jean-Claude Pruvost, Dijon (FR); Jeremy Langot, Mulsans (FR); Jean-Remy Adamski, Dijon (FR)

(73) Assignee: Thomson Licensing, Boulogne-Billancourt (FR)

( * ) Notice: Subject to any disclaimer, the term of this patent is extended or adjusted under 35 U.S.C. 154(b) by 160 days.

(21) Appl. No.: 10/444,832

(22) Filed: May 23, 2003

(65) Prior Publication Data

US 2004/0032195 A1 Feb. 19, 2004

(30) Foreign Application Priority Data

May 31, 2002 (FR) ..... 02 06673

(51) Int. Cl.[7] ..... H01J 1/28; H01J 9/04

(52) U.S. Cl. ..... 313/346 R; 313/346 DC; 313/310; 313/311; 313/337; 313/341; 445/50; 445/51

(58) Field of Search ..... 313/346 DC, 346 R, 313/341, 310, 311, 337; 445/50, 51; 428/375

(56) References Cited

U.S. PATENT DOCUMENTS 5,990,608 A 11/1999 Shiroishi ..... 313/412

FOREIGN PATENT DOCUMENTS

| | | |
|---|---|---|
| EP | 0890972 A1 | 1/1999 |
| EP | 1063668 A2 | 12/2000 |
| GB | 1522387 A | 8/1978 |

OTHER PUBLICATIONS

Patent Abstract of Japan, Nakamura Shinya, Porous Sintered Base, Manufacture Thereof and Method for Evaluating Porosity of Porous Material, Pub #06103885, Pub. Date—Apr. 15, 1994. One Page.

Patent Abstract of Japan, Hatakeyama Junji, Impregnated Type Cathode Body Structure and its Manufacture, Pub #05114352, Pub Date—May 7, 1993. One Page.

Patent Abstract of Japan, Sato Kyoichi, Impregnated Cathode, Pub 60017831, Pub. Date—Jan. 29, 1985. One Page.

*Primary Examiner*—Nimeshkumar D. Patel
*Assistant Examiner*—Sharlene Leurig
(74) *Attorney, Agent, or Firm*—Joseph S. Tripoli; Harvey D. Fried; Richard LaPeruta, Jr.

(57) ABSTRACT

Body (1) formed from a porous matrix impregnated with an electron-emitting material, defined by external faces (11, 12, 13) that all have a roughness of less than 0.2 $\mu$m.

Because of this surface finish, the operation and the lifetime of the cathodes provided with such cathode emissive bodies are substantially improved.

14 Claims, 4 Drawing Sheets

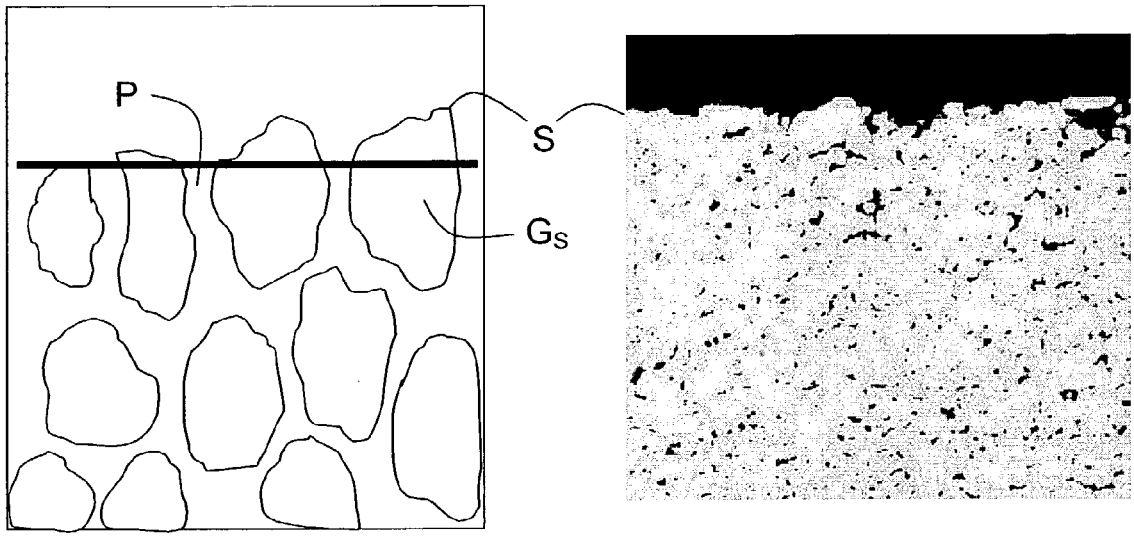
A Fig.3 B
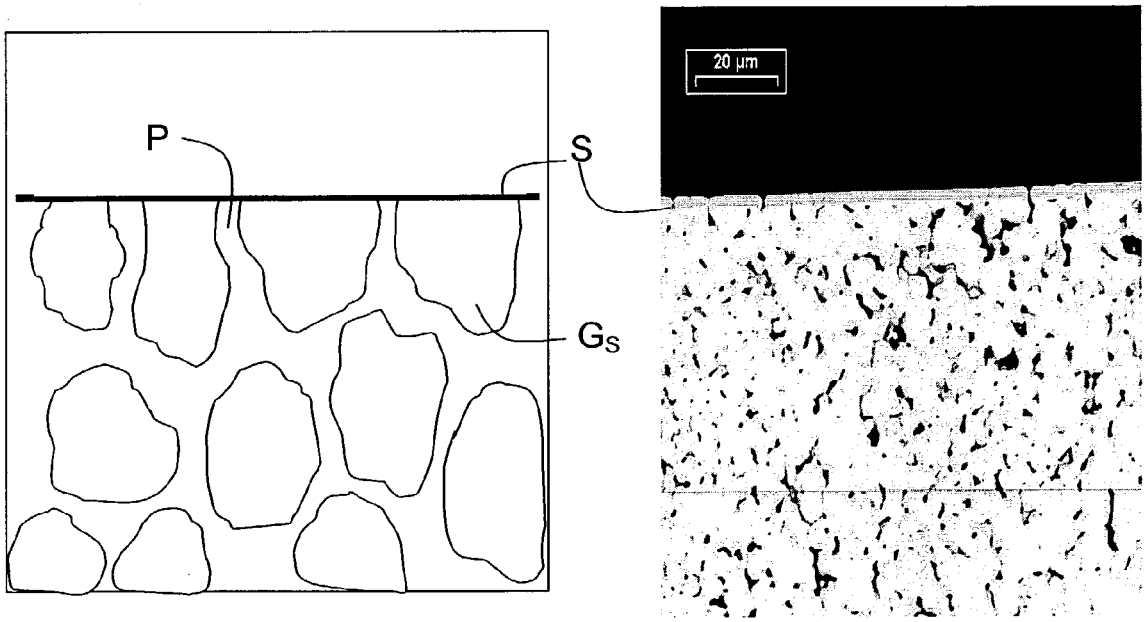
A Fig.4 B

CATHODE EMISSIVE BODY FOR AN IMPREGNATED CATHODE OF AN ELECTRON TUBE

BACKGROUND OF THE INVENTION

The invention relates to an "impregnated"-type cathode for an electron gun, that can be used in electron tubes, such as klystrons or gyrotrons, and more especially in cathode ray tubes for displaying images.

Referring to FIG. 2, a cathode of the "impregnated"-type for an electron gun comprises:

- a porous cathode emissive body 1 forming that part of the cathode that undergoes thermally induced electron emission, formed from a porous matrix impregnated with an electron-emitting material;
- a metal dish 2 into which the emissive body 1 is inserted;
- a metal sleeve 3, preferably made of a refractory metal such as molybdenum, tantalum or tungsten, closed at one end by the dish 2; such a sleeve is also called a cathode skirt; and
- inside the sleeve, a heating filament 4 that extends to a point close to the dish 2 and is suitable for heating the emissive body 1 in vacuum to a temperature of around 1000° C.

That surface of the porous cathode emissive body which is on the opposite side from that in contact with the bottom of the dish forms the emissive surface of the cathode.

Such impregnated cathodes are used as electron sources in image display cathode ray tubes of the monitor type or in television tubes and high-definition tubes (HDTV, CDT, CRT), in microwave electron tubes of the klystron type or gyrotron type, or in other types of electron tubes for lasers, magnetron radar, amplifiers and power supplies, and ion generators and propulsion units (for satellites).

The cathode emissive body of an impregnated cathode for a display cathode ray tube has a small thickness, which limits the amount of electron-emitting material available and thus limits the lifetime of the cathode; it has been established that the lifetime characteristics of such an impregnated cathode depend on the rate of evaporation of the main component of the electron-emitting material, which is generally barium; moreover the evaporated barium recondenses on other parts of the tube that are cooler, especially the counterelectrodes of the cathode, from where it emits parasitic electrons that impair the operation of the tube; furthermore, the emitting surface of the cathode may deteriorate over the course of operation by the impact of ions, which impair the uniformity of the surface electron emission distribution.

To limit these drawbacks, the document EP 0890972 (MATSUSHITA) discloses an impregnated cathode whose cathode emissive body has a lower porosity near the emissive surface than in the core or through the depth.

For another purpose, namely to increase the resistance of the impregnated cathode to ion bombardment, the document EP 0831512 (TOSHIBA) provides, conversely, a higher porosity near the emissive surface than in the core or through the depth.

Moreover, documents JP60-017831 and JP05-114352 disclose processes for manufacturing cathode emissive bodies for an impregnated cathode, comprising a step in which, after impregnation with the electron-emitting material, the emissive surface of these bodies is abraded, especially by polishing, essentially for the purpose of cleaning this emissive surface and of removing any particles of the impregnation material from the surface; cathode emissive bodies are therefore obtained in which only the emissive surface has a low roughness, for example between 0.2 $\mu$m and 3.2 $\mu$m; no indication is given about the porosity of the surface layer immediately beneath the emissive surface, with respect to the porosity in the core of the cathode emissive body.

The document JP06-103885 (TOSHIBA) teaches that, by polishing the emissive surface so as to lower its roughness, it is possible to limit the evaporation of electron-emitting material during operation of the cathode and thus improve the operation and the lifetime.

The document U.S. Pat. No. 5,990,608 recommends a roughness of the emissive surface of less than 10 $\mu$m in order to increase the emittance of this surface (cf. FIG. 12 of that document).

To make it easier to form a film of emissive material on the emissive surface, the document EP1 063 668 teaches the polishing of this surface until a roughness of less than or equal to 3 $\mu$m, or even 1 $\mu$m, is obtained.

Finally, the document GB 1 522 387 teaches the polishing of the emissive surface in order to remove therefrom the film of barium scandate which would be formed thereon.

Some of the documents cited therefore teach that a modification of the morphology only on the emissive surface (roughness) of the cathode emissive body and/or of the layer subjacent to this surface (porosity) improves the operation of the impregnated cathode and its lifetime.

BRIEF DESCRIPTION OF THE INVENTION

The object of the invention is to further improve the operation of impregnated cathodes and their lifetime by a particularly inexpensive method.

For this purpose, the subject of the invention is a cathode emissive body for an impregnated cathode of an electron tube, formed from a porous matrix impregnated with an electron-emitting material, defined by external faces comprising an emissive surface, wherein said external faces including the lateral surface have a roughness of less than 0.2 $\mu$m.

According to the essential feature of the invention, contrary to the prior art, not only is the emissive surface polished so as to have a roughness of less than 0.2 $\mu$m, but also at least the lateral surface, that is to say the sides, of the cathode emissive body; preferably, all the external faces of the emissive body are surface-treated, preferably polished, so as to have this low roughness.

The roughness of the faces is measured by a conventional method, which comprises a profilometer measurement perpendicular to these faces; the measured profile may be represented by the distribution of its depth relative to a given reference line; according to the French standard AFNOR E 05.015/017/052, this reference line (Ox) is the straight line taken parallel to the general direction of the profile and passing through its upper points; plotted on the ordinate axis (Oz) perpendicular to (Ox) are the measured depths of the profile; the deviation of the roughness profiles from this reference line Ox may be regarded as a variable having a certain statistical distribution; the position of the mean line of the profile is thus calculated; the arithmetic mean deviation of the depth relative to this mean line corresponds to the desired roughness value $R_a$.

Because the roughness $R_a$ is less than 0.2 $\mu$m on all the faces of the cathode emissive body, the operation and the lifetime of the impregnated cathodes provided with such cathode emissive bodies in electron tubes, especially image display cathode ray tubes, is more greatly improved than in the prior art; without wishing to be tied down to any definitive explanation, it seems that the evaporation of cathode emissive material during operation of this type of cathode, especially the evaporation of barium, takes place not only at the emissive surface but also at all the external faces of the cathode emissive body; in the prior art, only the emissive surface of the cathode emissive body was treated in order to limit the evaporation of cathode emissive material, which does not prevent "leakage" of this material via the other faces; the invention proposes, to limit any "leakage" from where it arises, to treat all of the external faces of the cathode emissive body that are exposed to the atmosphere of the electron tube, not only the emissive surface but also the lateral surface of the cathode emissive body.

For this purpose, it has been found that a surface treatment suitable for obtaining a roughness of less than 0.2 $\mu$m makes it possible for the operation and the lifetime of the cathodes to be very substantially improved; compared with untreated cathodes, the increase in the lifetime has been estimated to be a factor of greater than 2.

Preferably, said external faces defining the cathode emissive body have a roughness of less than or equal to 0.1 $\mu$m.

A roughness as low as this is preferably obtained by a step of abrading, and even more especially of polishing, the cathode emissive bodies after impregnation; this abrasion treatment may be carried out dry by spraying a very fine abrasive or polishing grit onto all the faces of the cathode emissive body, or carried out wet by spraying a suspension of abrasive grit; it may be carried out by the friction of these faces against a polishing felt charged with a very fine abrasive or polishing grit, or a suspension of this grit; it may also be carried out by grinding with a grinding disk.

Preferably, a bulk abrasion or polishing technique is used; in such a technique, a batch of cathode emissive bodies already impregnated with electron-emissive material is placed pêle mêle, in a container mounted on a rotation shaft, with the very fine abrasive or polishing grit, or a suspension of this grit, and then the container is rotated for a time suitable for obtaining the desired roughness; the advantage of such a method is that a low roughness is obtained on all the faces of the cathode emissive bodies directly and very inexpensively.

Preferably, the ratio of the area of the pores of the matrix that are open to said external faces of the cathode emissive body to the area of these faces is less than or equal to one half of the average volume porosity in the core of said matrix.

Thus, if the average volume porosity of a cathode emissive body is around 18% after impregnation, the ratio of the area of the pores of this body that are open to the external faces to the total area of these faces is, for example, around 9% or less than this value; the volume porosity is measured by conventional methods of calculating the density/volume ratio of the cathode emissive body before impregnation; the area of the pores is measured by automatic analysis of several images representative of the various external faces of the cathode emissive body.

This condition means that the surface porosity is less than the porosity through the depth, not only on the emissive surface, as in the prior art, but also on all the external faces of the cathode emissive body.

In practice, the abrasion or polishing surface treatment has the effect not only of lowering the roughness of the various faces, but also of partly closing the pores that are open to these surfaces, which results in a reduction in the surface porosity; this is in particular the case with chemical-mechanical polishing operations; the partial closure of the pores of all the faces of the cathode emissive body makes it possible to limit even further the losses by evaporation of electron-emitting material, especially barium.

Preferably, the ratio of the area of the pores of the matrix that are open to the external faces of the cathode emissive body to the area of these faces is between 4% and 9%.

Preferably, the average volume porosity in the core of the matrix in the cathode emissive body is between 16% and 22%; it is therefore the porosity of the cathode emissive body before impregnation.

Preferably, the porous matrix is based on tungsten and its tungsten content is greater than or equal to 50 wt % and the electron-emitting material is based on barium and its barium content is greater than 50 mol %. The porous matrix may be a tungsten-molybdenum mixture.

The subject of the invention is also an "impregnated"-type cathode for an electron gun, comprising:

a metal dish;

a metal sleeve closed at one end by the dish;

a heating filament inside the sleeve;

which cathode comprises a cathode emissive body according to the invention, which is inserted into said metal dish.

The subject of the invention is also an electron gun which is provided with at least one cathode according to the invention; in the conventional case of three-color guns of "color" cathode ray tubes, the electron gun has three cathodes, one for each primary color.

Preferably, for each cathode of this gun, a counterelectrode G1 is arranged facing the emissive surface of said cathode emissive body and is provided with a hole approximately centered on said surface, with the width of the peripheral region of the emissive surface facing the perimeter of said hole having a minimum value $L_{min}$ of less than or equal to 200 $\mu$m.

The subject of the invention is also a cathode ray tube provided with a gun according to the invention.

The subject of the invention is also a process for manufacturing a cathode emissive body according to the invention, which comprises an operation of treating the surface of said external faces in order to lower its roughness and, optionally, the surface porosity, that is to say the ratio of the area of the pores that are open to these faces to the area of these faces.

Preferably, said surface treatment operation is a polishing operation.

Preferably, said surface treatment operation is carried out in bulk.

Preferably, the process also includes an operation of impregnating the matrix with the electron-emitting material, said surface treatment operation being carried out after said impregnation operation.

Preferably, said external faces of the cathode emissive body refer to all of the external faces of this body.

BRIEF DESCRIPTION OF THE DRAWINGS

The invention will be more clearly understood on reading the description that follows, given by way of nonlimiting example and with reference to the appended figures in which:

FIGS. 3A and 3B show, respectively, a schematic sectional view and the corresponding micrograph of one of the faces of the cathode emissive body of FIG. 1, before surface treatment according to the invention;

FIGS. 4A and 4B show, respectively, a schematic sectional view and the corresponding micrograph of the same face of the cathode emissive body of FIGS. 3A and 3B, having here, according to one method of implementing the invention by polishing, a very low roughness;

DESCRIPTION OF THE PREFERRED EMBODIMENTS

To simplify the description and to bring out the differences and advantages that the invention has over the prior art, identical references are used for elements that fulfil the same functions.

Figure 1:
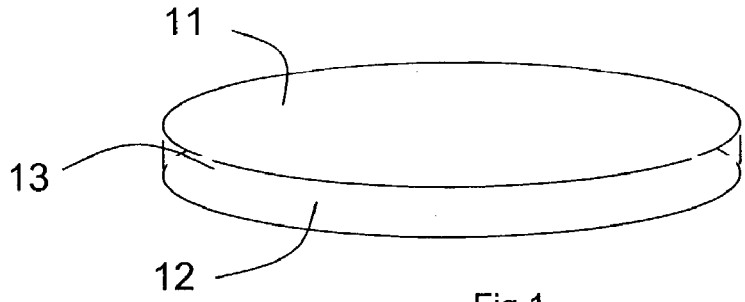
FIG. 1 shows, in perspective, a cathode emissive body for a cathode of the type shown in FIG. 2.

One method of manufacturing a cathode emissive body for an impregnated cathode according to the invention will firstly be described, this being formed from a porous matrix impregnated with an electron-emitting material, which here has the form of a pellet shown in FIG. 1; the external faces of this pellet consist here of an emissive upper face 11, a lower face 12, opposite the emissive face and intended to come into contact with the bottom of the dish 2 of the cathode, and a circular side face 13 joining the upper face to the lower face.

The porous matrix may, to take a specific example, be based on nickel or may be obtained by pressing and sintering a ceramic or refractory metal powder; the material of the porous matrix of the cathode emissive body is preferably chosen from the group comprising tungsten, molybdenum, rhenium, osmium, iridium, and alloys thereof, and alumina; as an example, a tungstenbased material is chosen here; the pressing pressure and the sintering conditions, especially the temperature and time, are tailored in a manner known per se in order to obtain a solid body having, before impregnation, a volume porosity of preferably between 15% and 30%; this porosity is intended to serve as a reservoir for the cathode emissive materials; for a higher porosity, the pellet would not have sufficient mechanical strength; for a lower porosity, the reservoir of cathode emissive material would be insufficient to obtain an acceptable lifetime.

Using a method known per se, for example at high temperature under hydrogen, the matrix is then impregnated with the cathode emissive material; the electron-emitting material is preferably chosen from the group comprising barium, strontium, calcium, aluminum, scandium and osmium, or a mixture of one or more of these elements; as an example, a so-called "4/1/1" mixture is used as impregnation material, this being well known in impregnated cathodes, consisting at the start of a mixture of four moles of barium carbonate, 1 mole of calcium carbonate and 1 mole of alumina; the operating characteristics of a cathode emissive body of an impregnated- or reservoir-type cathode depend in particular on the pore volume of its matrix or on the volume of the reservoir, on the nature of the cathode emissive material that fills the pores and on the operating temperature of the cathode; in the case of a cathode ray tube, the cathode emissive body must contain a sufficient amount of emissive material to operate for at least 20000 hours in the tube; in order to fill the pores in the matrix, these pores have to be connected together, that is to say that the porosity must be open, which in practice requires the matrix to have, before impregnation, an overall porosity of greater than or equal to 15%.

According to an alternative way of preparing the cathode emissive body, the material of the matrix and of the cathode emissive material are sintered simultaneously.

A "green" impregnated cathode emissive pellet, untreated according to the invention, is therefore obtained.

Since the loss of cathode emissive material, by diffusion and sublimation during operation of the cathode, and the rate of depletion are proportional to the area of exchange between the pellet and the vacuum in the electron tube on which the cathode is mounted, it is beneficial to limit this exchange area.

For this purpose and at this stage in the process, it is possible, on all the external faces of the pellet according to the invention:

a) either to modify the surface finish, by reducing the roughness and therefore the exchange area;
b) or to reduce the size of the pores that are open to the surface;
c) or to reduce the number of surface pores;
d) or any combination of the means a), b) and/or c).

The means a) aims to reduce the roughness of the various external faces of the pellet; the arithmetic roughness $R_a$ of a "green" pellet is generally around 0.3 $\mu$m; after treatment according to the invention, the aim is to have a roughness of less than 0.2 $\mu$m, preferably less than or equal to 0.1 $\mu$m, on all the faces of the pellet.

To measure the roughness of the faces of the pellet, a conventional measurement method using a "laser" profilometer or a needle sensor is used, for example of the "SURFTEST" type from Mitutuyo; in the latter case, the tip of the needle used has a diameter of around 0.02 mm, the run speed of the sensor is around 2 mm/s and the cut-off of the sensor is set at about 0.8 mm.

The means b) and/or c) are aimed at reducing what will be called the "surface porosity"; it has been found that the surface porosity of a "green" pellet is identical to or even higher than its mean porosity; this surface porosity is characterized, for example, by the mean diameter and the mean surface density of the pores that are open to the surface of the pellet, on all its external faces; the above means b) aims to reduce the mean diameter, while the means c) aims to reduce the surface density of the pores.

By combining these two criteria, it is also possible to express the surface porosity by the ratio of the total area of the pores open to all the external faces of the pellet to the developed area of these faces; after treatment according to the invention, the aim is preferably to have, for this ratio, a value of less than or equal to one half of the overall volume porosity of the matrix, especially a value of between 4% and 9%, on all the faces of the pellet.

To measure the surface porosity of the faces of the pellet, micrographs of the surface are used, these being taken, at the center and at one third from the edges of the pellet, using a scanning microscope with a magnification of around 2000 and a software treatment for the image analysis of these micrographs, for example of the "Leica" type; for example, digital micrographs having a magnification of 2000 and a resolution of 512 by 512 pixels, with 256 gray levels, are used; the analysis software is tailored according to the surface to be analyzed, the photographic equipment and the "illumination" of the surface.

The surface treatment applied to the green impregnated pellet, in order to obtain an impregnated pellet according to the invention, consists of a chemical or chemical-mechanical operation to grind, hone or polish all of the faces of the pellet.

One of the following three surface treatment techniques will, for example, be used:

dry or wet bulk polishing using an alumina-based polishing grit;

grinding with a grinding disk or a cutting tool;

friction of the faces of the pellet by a punch or a tool.

Preferably, a polishing operation which it is found advantageously gives the above effects a), b) and c) simultaneously is carried out; preferably bulk polishing is carried out, which allows the surface of a large number of pellets to be simultaneously treated on all their faces.

The surface treatment, especially polishing, conditions are adapted so as to obtain pellets having a roughness of less than or equal to 0.1 $\mu$m and a surface porosity, measured by the ratio described above, of between 4% and 9% on all their faces; thus, for a matrix pore volume of around 18%, a surface porosity of around 6% is conventionally obtained.

FIGS. 3 and 4 show, schematically in the case of 3A and 4A and micrographically in the case of 3B and 4B, sectional views of a portion of the surface region representative of one of the faces of the pellets, before treatment in the case of FIG. 3 and after treatment in the case of FIG. 4; these figures very clearly illustrate the reduction in surface roughness specific to the invention: the polishing abrades the grains $G_S$, planarizing the entire surface S and lowering the roughness to a level of less than or equal to 0.1 $\mu$pm.

The polishing also has the effect of reducing the open area of the pores on all the external faces of the pellet; this is without doubt a chemical-mechanical effect, conventional in the polishing field; the surface porosity is reduced by a factor of two or even of three, by this operation.

Figure 2:
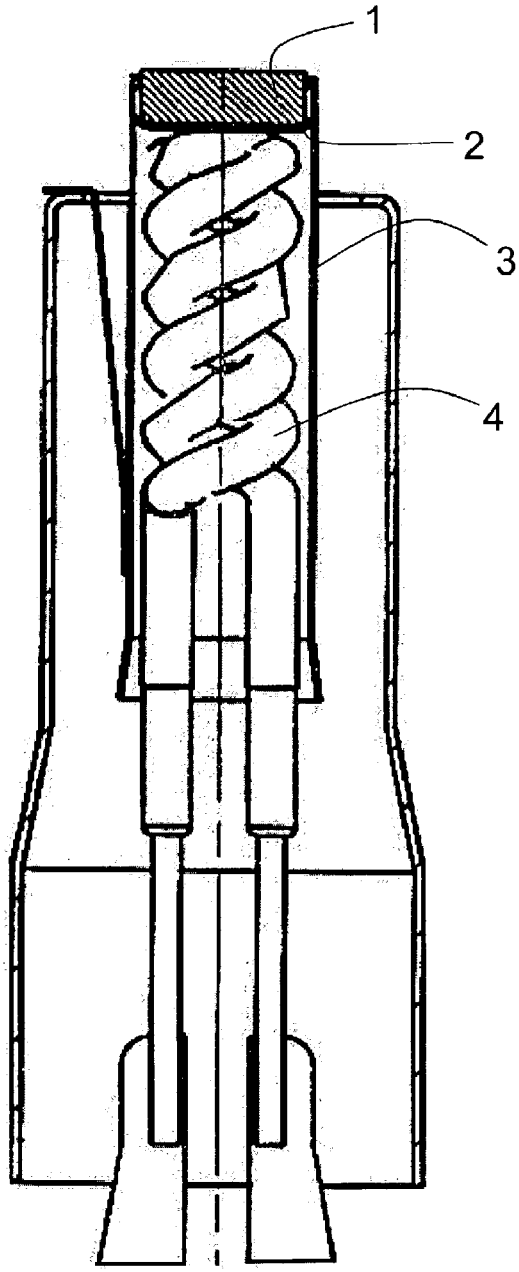
FIG. 2 already described, shows an impregnated-type cathode for a cathode ray tube.

After surface treatment, especially polishing, an impregnated cathode emissive pellet ready for use is then obtained; as shown in FIG. 2, this pellet is mounted in a dish 2, itself supported by a metal sleeve 3 provided with a heating filament 4; the impregnated cathode according to the invention is then obtained.

By means of the surface polishing treatment according to the invention, in the case in which the pellet has, after treatment, a roughness of less than or equal to 0.1 $\mu$m and a surface porosity of between 4% and 9%, if the impregnation cathode emissive material is based on barium of the "4/1/1" type described above, the loss of cathode emissive material during 90 weeks of operation of this cathode under standard conditions, or even greatly accelerated conditions compared with the same cathode in which the pellet has not undergone a polishing surface treatment, is found to be reduced by a factor of two; compared with a cathode whose pellet has undergone this polishing surface treatment only on its emission upper face 11, as for example in the prior art, it is also found that there is a considerable reduction in the loss of cathode emissive material and a substantial increase, by a factor of around 2, in the lifetime; this is because, since the law expressing the depletion of the function of lifetime goes as the square root of t (time), a significant increase in the lifetime of the cathode is obtained.

It has been found that it is highly preferable to carry out the surface treatment described above on pellets that have already been impregnated and that the same improvements are not obtained if this treatment is carried out on the porous matrix before impregnation.

The invention also has the following advantages:

reduction in electrical losses in electron guns and tubes by a reduction in parasitic coatings, especially on the counterelectrodes;

any surface defects and possible cracks on the surface of the pellets following the surface treatment according to the invention are revealed, which makes it possible to improve manufacturing quality inspection.

The improvement in performance is particularly evident on small pellets, used in particular in cathode ray tubes with low energy consumption; this is because the depletion or loss of cathode emissive material has the following edge effect on the emissive surface: over the entire periphery of the emissive surface 11 of the pellet 1, over the lifetime of the cathode, the porous matrix becomes depleted in cathode emissive material so that the emissive surface has a depleted peripheral region of increasing width; the smaller the diameter of the pellets, the greater is the part of the emissive surface represented by this depleted region; since, by virtue of the invention, all the faces of the pellet, especially its lateral face 12, are polished, this depleted peripheral region increases less quickly in width than in the prior art; the lifetime of small-diameter pellets, especially those of a diameter of less than or equal to 1.1 mm, is therefore substantially improved.

Figure 7:
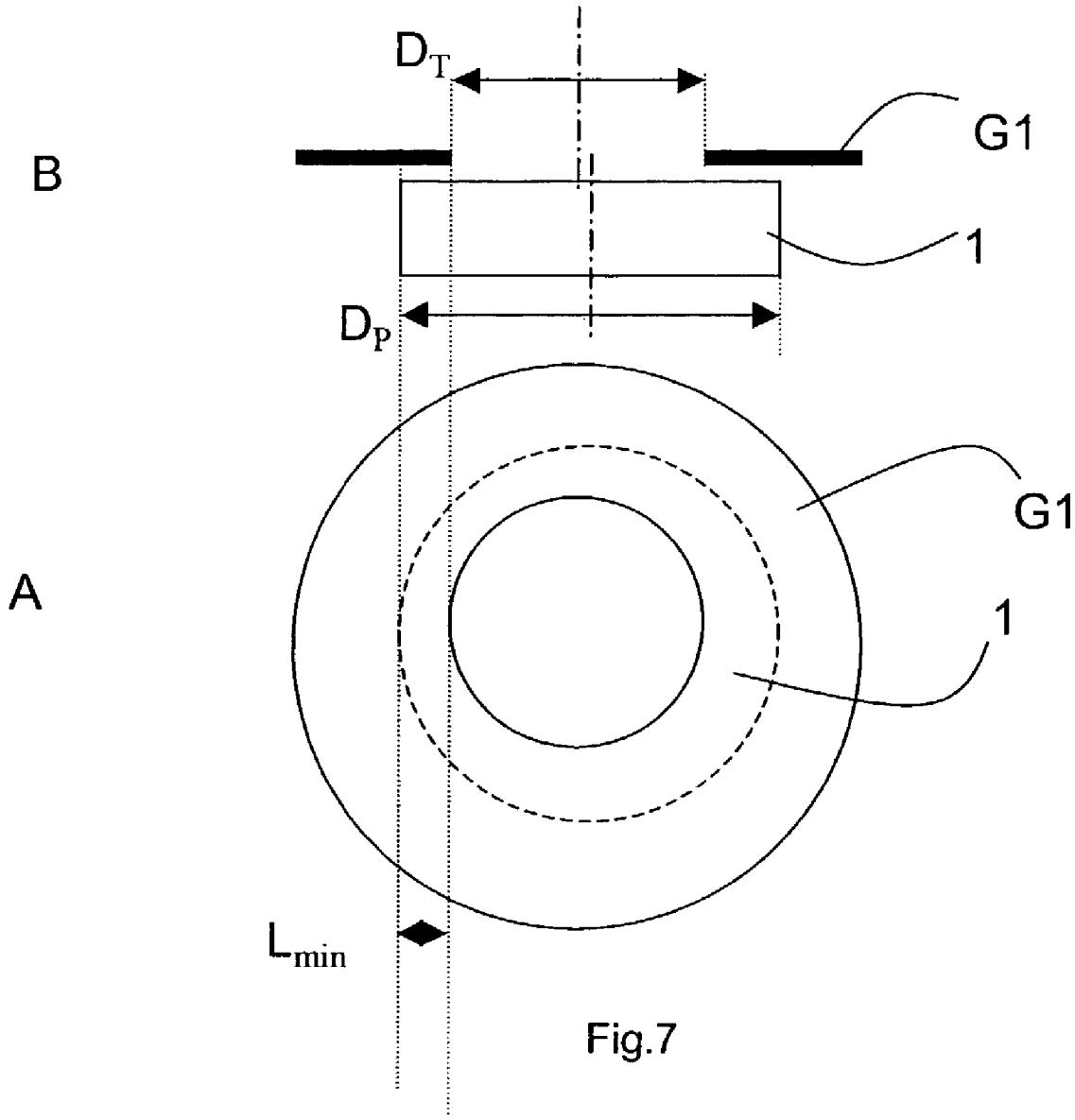
FIG. 7 shows, as a top view (part A) and as a lateral section (part B), the relative arrangement of a cathode emissive body and a counterelectrode according to one embodiment of the invention.

FIG. 7 illustrates this point schematically; the width of the depleted peripheral region of the cathode emissive body may be up to 200 $\mu$m, which corresponds to a reduction in diameter of the effective emissive area of 400 $\mu$m; since the diameter $D_T$ of the hole in the first counterelectrode or grid G1 is generally around 500 $\mu$m, if the diameter $D_P$ of the pellet is less than or equal to 1.1 mm and if account is taken of the inevitable errors in centering the hole in the gate with respect to the cathode, generally of around 200 $\mu$m, it may be seen that the peripheral region of the emissive surface of the pellet 1 facing the perimeter of the hole in the grid G1 may, in certain parts of the perimeter, have a width $L_{min}$ of less than or equal to 200 $\mu$m and that there is a risk of the depleted peripheral region encroaching on the hole in the grid, with the risk of seriously disrupting the operation of the electron tube in which this cathode is placed; thanks to the invention and the polishing of the lateral faces of the cathode emissive bodies, this risk is limited.

Figure 5:
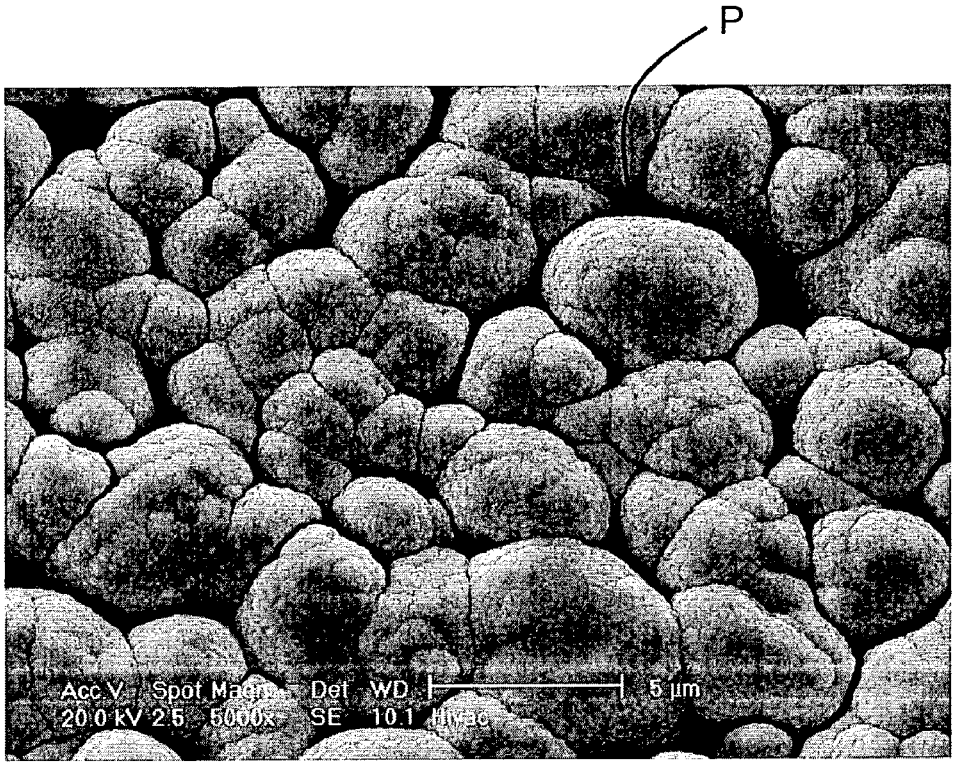
FIGS. 5 and 6 show, respectively, a micrograph of the top of the emissive surface of the cathode emissive body of FIG. 1 after a thin film of osmium has been deposited, with and without surface treatment according to the invention respectively.
Figure 6:
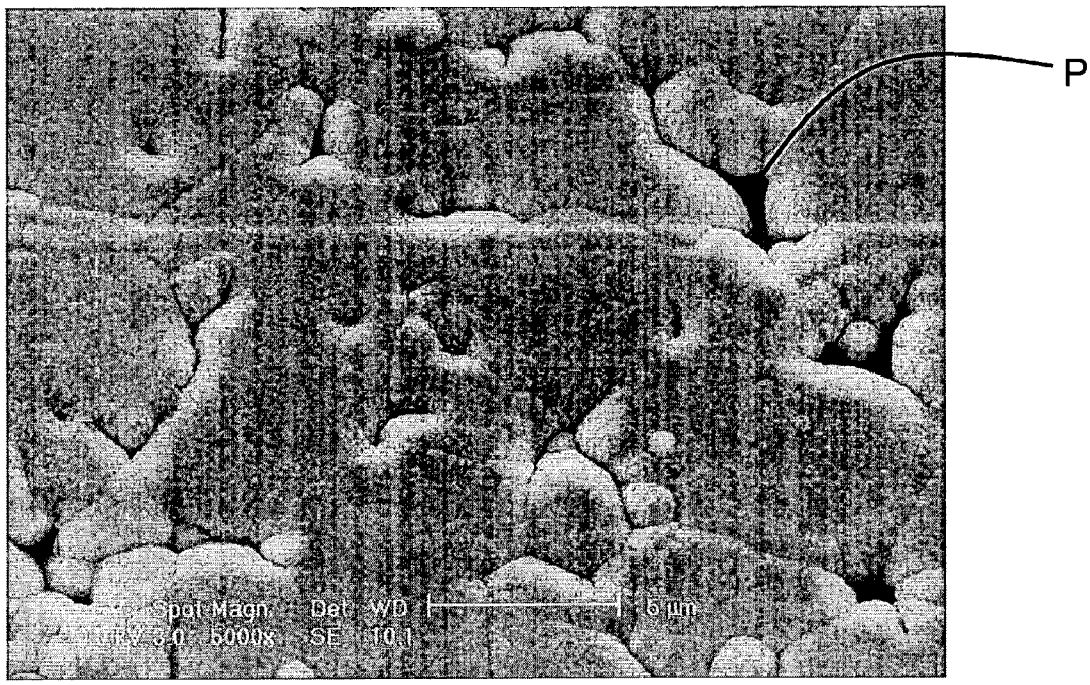

It is also known to improve the performance of cathode emissive bodies of impregnated cathodes by depositing a thin film of osmium, ruthenium and/or iridium on its emissive surface; it has been found that this improvement is greater on cathode emissive bodies surface-treated beforehand according to the invention than on cathode emissive bodies not surface-treated; FIGS. 5 and 6 show a micrograph under 5000× magnification of the top of the emissive surface 11 of a pellet after depositing a thin film of osmium 0.5 $\mu$m in thickness without surface treatment, in the case of FIG. 5, and with surface treatment according to the invention, in the case of FIG. 6; FIG. 6 shows a roughness and a surface porosity that are much less than in FIG. 5, which explain, at least in part, the observed improvement in the performance.

The present invention has been described with reference to a cathode of a cathode ray tube; it is obvious to a person skilled in the art that the invention can be applied to other types of electron tubes.

What is claimed is:

1. A cathode emissive body for an impregnated cathode of an electron tube, formed from a porous matrix impregnated with an electron-emitting material, defined by external faces comprising an emissive surface, wherein said external faces including a lateral surface have a roughness of less than 0.2 $\mu$m.

2. The cathode emissive body as claimed in claim 1, wherein said external faces defining it have a roughness of less than or equal to 0.1 $\mu$m.

3. The cathode emissive body as claimed in claim 1, wherein the ratio of the area of the pores of said matrix that are open to said external faces to the area of these faces is less than or equal to one half of the average volume porosity in the core of said matrix.

4. The cathode emissive body as claimed in claim 3, wherein the ratio of the area of the pores of said matrix that are open to said external faces to the area of these faces is between 4% and 9%.

5. The cathode emissive body as claimed in claim 4, wherein the average volume porosity in the core of said matrix is between 16% and 22%.

6. The cathode emissive body as claimed in claim 1, wherein:

said porous matrix is based on tungsten and its tungsten content is greater than or equal to 50 wt %: and said electron-emitting material is based on barium and its barium content is greater than 50 mol %.

7. An impregnated-type cathode for an electron gun, comprising:

a metal dish;

a metal sleeve closed at one end by the dish;

a heating filament inside said sleeve;

which cathode comprises a cathode emissive body as claimed in claim 1, which is inserted into said metal dish.

8. An electron gun, which is provided with at least one cathode as claimed in claim 7.

9. The gun as claimed in claim 8, comprising, for each cathode, a counterelectrode G1 facing the emissive surface of said cathode emissive body and provided with a hole approximately centered on said surface, wherein the width of the peripheral region of the emissive surface facing the perimeter of said hole has a minimum value $L_{min}$ of less than or equal to 200 $\mu$m.

10. A cathode ray tube, which is provided with a gun as claimed in claim 8.

11. A process for manufacturing a cathode emissive body as claimed in claim 1, which comprises an operation of treating the surface of said external faces in order to lower its roughness and, optionally, the surface porosity, that is to say the ratio of the area of the pores that are open to these faces to the area of these faces.

12. The process as claimed in claim 11, wherein said surface treatment operation is a polishing operation.

13. The process as claimed in claim 11, wherein said surface treatment operation is carried out in bulk.

14. The process as claimed in claims 11, which also includes an operation of impregnating the matrix with the electron-emitting material, wherein said surface treatment operation is applied after said impregnation operation.

* * * * *